US007387300B2

(12) United States Patent
Snow

(10) Patent No.: US 7,387,300 B2
(45) Date of Patent: Jun. 17, 2008

(54) PLAYER-BANKED FOUR CARD POKER GAME

(75) Inventor: Roger M. Snow, Las Vegas, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 38 days.

(21) Appl. No.: 10/864,051

(22) Filed: Jun. 8, 2004

(65) Prior Publication Data

US 2004/0217548 A1 Nov. 4, 2004

Related U.S. Application Data

(63) Continuation-in-part of application No. 10/152,325, filed on May 20, 2002, now abandoned.

(51) Int. Cl.
*A63F 1/00* (2006.01)

(52) U.S. Cl. ..... 273/292; 273/274; 463/13

(58) Field of Classification Search ..... 273/292, 273/274, 309; 463/13, 12
See application file for complete search history.

(56) References Cited

U.S. PATENT DOCUMENTS

| | | | |
|---|---|---|---|
| 4,743,022 | A | 5/1988 | Wood |
| 4,836,553 | A | 6/1989 | Suttle et al. |
| 4,861,041 | A | 8/1989 | Jones et al. |
| 5,022,653 | A | 6/1991 | Suttle et al. |
| 5,046,736 | A | 9/1991 | Bridgeman et al. |
| 5,098,107 | A | 3/1992 | Boylan et al. |
| 5,174,579 | A | 12/1992 | Griffiths |
| 5,255,915 | A | 10/1993 | Miller |
| 5,257,784 | A | 11/1993 | Boylan et al. |
| 5,257,810 | A | 11/1993 | Schorr et al. |

(Continued)

FOREIGN PATENT DOCUMENTS

| | | |
|---|---|---|
| GB | 667345 | 2/1952 |
| GB | 94/14822 | 7/1994 |
| GB | 94/26324 | 12/1994 |

OTHER PUBLICATIONS

KISS Guide To Gambling by John Marchel, DK Publishing Inc., 2001, Glossary, "No Limit", p. 344.*

(Continued)

*Primary Examiner*—Benjamin Layno
(74) *Attorney, Agent, or Firm*—Mark A. Litman & Associates, P.A.

(57) ABSTRACT

A player-banked casino game utilizes at least one deck of playing cards, the game comprising: each player placing at least one wager to participate in the casino game; dealing a first number of cards to a dealer as a banker's hand, the first number of cards being greater than the number of cards to be used in determination of a poker rank hand for the banker's hand; dealing a second number of cards to each player, the second number of cards being greater than the number of cards to be used in determination of a poker rank hand for each player; the dealer discarding at least one card from the banker's hand to form a resulting single dealer hand; each player discarding at least one card to form a resulting player's hand for each player, wherein the number of cards in resulting player's hands and the resulting banker's hand are equal; and resolving each player hand against the banker's hand according to predetermined game rules. The initial player's wagers must be at least matched with a Game Bet (or play bet of 1× or more of the Ante) to remain in the game after players have received their cards. The Game Bet multiplier is selected by the player.

48 Claims, 1 Drawing Sheet

U.S. PATENT DOCUMENTS 5,265,877 A 11/1993 Boylan et al.
5,275,415 A 1/1994 Wisted
5,288,081 A 2/1994 Breeding
5,294,128 A 3/1994 Marquez
5,308,065 A 5/1994 Bridgeman et al.
5,366,228 A 11/1994 Kangsanaraks
5,377,973 A 1/1995 Jones et al.
5,377,994 A 1/1995 Jones
5,395,120 A * 3/1995 Malek ..... 273/292
5,397,128 A 3/1995 Hesse et al.
5,431,408 A 7/1995 Adams
5,489,101 A 2/1996 Moody
5,494,295 A 2/1996 Potter et al.
5,505,449 A 4/1996 Eberhardt et al.
5,531,448 A 7/1996 Moody
5,538,252 A 7/1996 Green
5,584,486 A 12/1996 Franklin
5,630,757 A 5/1997 Gagin et al.
5,653,444 A 8/1997 Dahl
5,660,393 A 8/1997 Dreger
5,673,917 A 10/1997 Vancura
5,685,774 A 11/1997 Webb
5,697,614 A 12/1997 Potter et al.
5,718,430 A 2/1998 Aramapakul et al.
5,732,950 A 3/1998 Moody
5,762,340 A 6/1998 Feola ..... 273/292
5,851,011 A 12/1998 Lott
5,897,436 A 4/1999 Singer et al.
6,012,719 A 1/2000 Webb
6,027,119 A 2/2000 De Lisle
6,056,641 A 5/2000 Webb ..... 463/13
6,113,101 A * 9/2000 Wirth ..... 273/274
6,113,103 A 9/2000 Mostashari
6,170,827 B1 1/2001 Lombardo et al.
6,206,373 B1 3/2001 Garrod
6,229,534 B1 5/2001 Gerra et al.
6,237,916 B1 5/2001 Webb ..... 273/292
6,273,424 B1 8/2001 Breeding
6,345,823 B1 2/2002 Webb ..... 273/292
6,561,897 B1 * 5/2003 Bourbour et al. ..... 463/13
6,607,443 B1 8/2003 Miyamoto et al.
2002/0103018 A1 * 8/2002 Rommerdahl et al. ..... 463/16
2002/0175468 A1 * 11/2002 Kenny et al. ..... 273/274
2003/0199316 A1 10/2003 Miyamoto et al. ..... 463/35
2004/0150163 A1 8/2004 Kenny et al. ..... 273/292
2004/0160006 A1 8/2004 Kenny et al. ..... 273/274

OTHER PUBLICATIONS

Copyright filing with the Bureau voor de Intellectuele Eigendom, Aruba, 13 pgs (Jan. 13, 1998).
"Show Vice Cards", Scarne's Encyclopedia of Games, John Scarne, Harper & Row Publishers, pp. 28-29, 1973.
Published Rule Sheet for Casino Poker from Vegas World, 1 page (1982).
"Card Craps", Scarne's Encyclopedia of Card Games, pp. 321-323, (1948).
Three Card Poker Disclosure by Derek J. Webb.
Scarne's Guide to Modern Poker, Constable and Company Limited, 1980, "Brag", pp. 159-160.
Hoyle's Modern Encyclopedia of Card Games by Walter Gibson, p. 250, 3 pages.

* cited by examiner

PLAYER-BANKED FOUR CARD POKER GAME

RELATED APPLICATIONS

This application is a continuation-in-part of U.S. patent application Ser. No. 10/152,325 filed May 20, 2002 now abandoned.

BACKGROUND OF THE INVENTION

1. Field of the Invention

The present invention relates to the field of games, card games, wagering card games, player-banked games and especially poker-type casino wagering games. More specifically, the method of the present invention is an enhancement to a game of poker by having a dealer or banker provided with a casino table poker game.

2. Background of the Art

As a leisure time activity, poker and other card games have been popular for many years. The capital requirements for playing poker and other table card games are very low. All that are needed are one or more decks of cards, a playing surface and a few participants. Five card poker is a game that most people know how to play and many games have been developed using the same basic priority or rank order of winning poker hands: Royal Flush, Straight Flush, Four of a Kind, Full House, Flush, Straight, Three of a Kind, Two Pair, One Pair and high card(s) in hand.

For some time, it had been difficult to adapt the rules of poker into a casino table game in which each player plays against the house, rather than against other players. Although club-type games with players wagering against each other have been popular, it was desirable for a game to be played where the house received a more direct payback from the game. In a conventional poker game, a number of players (greater than one) are each dealt a poker hand by one player (or the house dealer who does not play in the game) who acts as the dealer. The player with the highest ranking hand based on the established priority ranking of poker hands wins. Each player in turn deals a hand as the game continues. It is usually essential to have wagering steps in the game to maintain the interest and excitement of the game. In the absence of wagering, there is little to commend the play of poker.

Many places, both within and without the United States, have legalized gaming. Poker is one of the games of chance offered in both casinos and card rooms. In a conventional card room poker game, the house provides a dealer, the playing cards, the table and chairs, but the house does not play a hand. The house collects a nominal percentage of each player's bet ("the rake") that compensates the house for providing the facilities to the players. Alternatively, the house may charge each player a set amount per hand or for a specified length of time of play. Each player is competing not against the house, but against all the other players with the highest hand winning the total of all the wagers made on that hand.

Many people do not like to play card room poker because each player is competing against his fellow players, not against the house. Many people would rather attempt to win money from an impersonal source, the house or the casino, rather than from their fellow players with whom they may be acquainted. Card room poker also tends to not offer any bonus payments for particularly good hands, although bonuses are sometimes paid for highest hands in tournaments or for specific combinations of hands at poker tables (e.g., a losing hand of at least a full house). While a Royal Flush is a rare occurrence and generates a thrill for any poker player, the player collects the same total wager that he would have collected if the hand was won with a Three-of-a-Kind.

In the past fifteen years, a number of card games have been introduced to provide poker-type card games as house-banked casino table games. These games have focused on a number of elements in providing excitement and staying power for the games. The games must be quickly understood by players. The rules must be simple and clear. The resolution of wagers by the dealer must be easily accomplished. The reading of hands by a dealer must not be complex. In addition, the games must provide a high enough hit frequency to appeal to players, yet allow the house to retain a profitable portion of the wagers. These needs have limited the number of successful games that have been designed and successfully introduced into the casino gaming market.

Among the successful games are Let It Ride Bonus® poker, Three Card Poker® game and Caribbean Stud® poker. These games have each achieved a high level of commercial success with different formats and attributes.

Let It Ride® stud poker is described in U.S. Pat. No. 5,288,081. The Bonus version of the game is described in U.S. Pat. No. 6,273,424. In this game, the player makes a wager in three parts, three cards are dealt to each player (there may be only a single player), and two common cards are dealt face down in front of the dealer. The player examines his/her three cards, evaluates the likelihood of a ranked hand (e.g., at least a pair of tens) being achieved with those three cards and the as yet unseen common cards. The player, based on judgment of that likelihood, may elect to withdraw the first of the three-part wager or keep the wager at risk. Upon the player making that decision, and withdrawing or allowing the first wager to remain at risk, a first of the common cards is turned face up. The player then can make another decision with regard to the play of the hand and whether there is a changed potential for a ranked hand. A second portion of the three-part wager is then withdrawn or allowed to remain at risk. After this decision, the last common card is exposed, and the rank of each player's hand, including the common cards, is evaluated. Payments are made to each player based on only the rank of hand achieved and the number of wagers left on the table from the original three-part wager. As noted, at least one wager must remain, as only two parts can have been withdrawn. Wagers are paid off at rates (or odds), for example, of 1:1 for pairs of at least 10's, 2:1 for two pairs, 3:1 for three-of-a-kind, 5:1 for straights, 7:1 for flushes, 12:1 for full houses, 50:1 for four-of-a-kind, 250:1 for straight flushes, and 1000:1 for Royal Flushes. The specific payout odds can be varied and often casinos choose payout tables that help them achieve a desired percentage hold. Side bonus wagers may also be placed in which ranked hands over three-of-a-kind receive fixed or progressive bonuses, such as $25,000 for a Royal Flush. The bonus payouts and hand combinations are typically displayed on a payout table on the table surface. The winning bonus combinations are typically a higher-ranking subset of the winning base game outcomes.

The Three Card Poker® game (e.g., as described in U.S. Pat. No. 5,685,774) deals three cards to each player and three cards to the dealer, all face down. Initially one or two optional wagers may be made by the player. One such wager is for the "Pair Plus" bonus bet, a bet on achieving a winning combination included in a payout table. Another wager is the game ante on which the player competes against the dealer. The Pair Plus bet in one example of the invention is a wager that the three card hand will have a rank of at least one pair or more. The hand is paid off in multiples of the bet depending upon the rank of the hand, with up to 40:1 or more paid out for three-of-a-kind. In the ante wager, if the player wants to compete against the dealer's hand (after viewing the rank of the player's hand), an additional wager equal to one or two times the ante must be placed by the player. House rules typically dictate that the amount of the Bet is 2× the amount of the Ante. The dealer's hand is then exposed. If the dealer does not have a hand of at least a certain qualifying rank (e.g., at least Queen high), the dealer's hand is not in play. If the player has not made the additional wager, the ante is collected by the dealer at some point in the play of the game. If the player has made the additional wager, the ante is paid off to the player if the dealer's hand has not qualified or if the dealer's hand is not as high a rank as the player's hand. If the dealer's hand has qualified, and the dealer's hand is higher than the player's hand, then the ante and the additional wager are collected by the house. If the dealer's hand qualifies (e.g., at least Queen high) and is lower than the player's hand rank, both the ante and additional wager are paid off, with multiples payable to the ante wager for certain high ranking hands (e.g., straights, flushes, straight flushes, three-of-a-kind, etc.). The ranking of the various poker hands is different in the three card game than in five card poker games.

In Caribbean Stud® poker, described in U.S. Pat. No. 4,836,533, a player makes an initial ante wager, and five cards are dealt to each player and to a dealer. The dealer exposes one of the five cards to influence the player. The player decides if the dealt player hand is of sufficient rank to compete against the dealer's hand. The player may fold the player's hand at that time, or continue the game by placing an additional wager (referred to as the "Bet") that is usually required to be twice the value of the ante. The dealer's hand qualifies for active play against the Bet with a rank of at least Ace-King. If the dealer qualifies, the rank of the players' hands are compared with the rank of the dealer's hand. Players with hands of higher rank than the dealer's hand win both the ante and the Bet. Players with hands of lower rank than the dealer's hand lose both the ante and the Bet. If an initial side bet (often referred to as the Jackpot side bet) has been made by the player, ranked hands of particularly high values (e.g., at least a Flush) are paid absolute bonus amounts or may be paid out of a progressive jackpot. This bonus side bet is paid whether or not the player's hand rank exceeds the rank of the dealer's hand.

Potter et al., U.S. Pat. Nos. 5,494,295 and 5,697,614 describe a casino table card game and apparatus in which a player may select any number of predetermined hand ranking rules to apply to the play of a hand. A player is dealt an initial, partial hand, and the player then elects from that initial hand which set(s) of predetermined hand ranking rules apply to the hand. In a preferred game, the dealer receives two separate bank hands, one that utilizes the hand ranks of standard poker and one that utilizes the hand ranks of low-ball poker. Once each player has received four of his five cards, each player decides which of the dealer's two hands to play against, with the option of playing against both (as in selecting both ways in a Hi-Low poker game). Then each player receives his or her fifth, and last, card. At this point, the "bank" hands are exposed and each player's hand is compared to the specific "bank" hand, or hands, that they played against, winners are determined, and wagers are settled.

U.S. Pat. No. 6,170,827 describes another poker-type casino table card game. This game may be played at a table with as many as seven players competing against a dealer. The play of the game is fairly complex, with each player having both multiple hands and utilization of a dealer's card. One method of play is to provide each player with three cards, and the dealer is provided with four cards. The dealer's play of cards is predetermined, while the players may select their desired holding. Player's hands are competing directly against the dealer's hand in each of the hands made by the player and the dealer.

It is always desirable to explore alternative games for play in the field of gaming tables to provide players with varied experiences and alternatives to known games.

SUMMARY OF THE INVENTION

A casino table poker game is played with poker hands of players competing against a poker hand of a dealer. A player enters the game by placing one or both of a Bonus Bet (also referred to as an Aces-Up wager) for competition against a pay table and an Ante for direct competition against the dealer. The player is dealt more cards than needed to form a poker hand. The dealer is also provided with more than the required number of cards, from which a number of cards are selected for the dealer's hand to play. The player is provided with bonus payouts (e.g., multiple returns) on the Aces-Up bet for ranked hands or a pair of Aces or better. The players' hands also compete directly against the rank of the dealer's hand if an additional play bet is placed to supplement the ante. The additional play bet may be varied by the player to be 1×, 2×, 3×, 4×, or 5× the amount of the ante. Bonuses may also be paid on the Aces-Up or ante wager with unusually high ranking player's hands (such as a straight flush or four of a kind), whether or not the rank of the player's hand exceeds the rank of the dealer's hand. In one player-banked form of the game, there is no Aces-Up bet, and the Ante and additional bets are combined by the dealer. Odds payouts are made on the combined Ante/additional bet when the player's hand beats the dealer's hand.

DETAILED DESCRIPTION OF THE INVENTION

Figure 1:
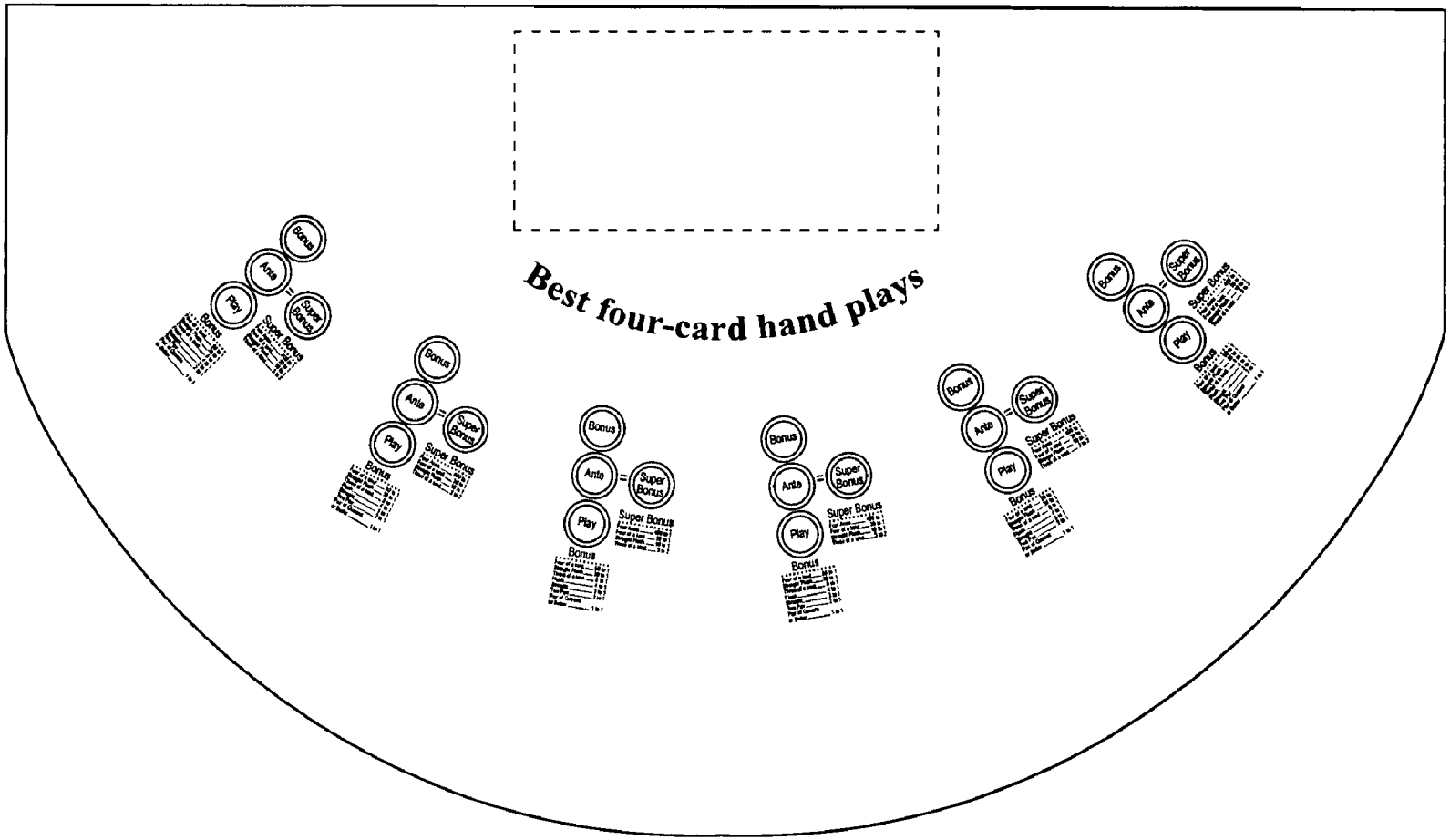
FIG. 1 is a plan view of a gaming table layout suitable for play of the game of the present invention.

A casino table card game is played on a table by at least one player and a dealer. The dealer usually represents the house or the casino in the play of the game. As shown in FIG. 1, wagering areas 10 are provided for each player, and card receiving areas 12 are available for each of the players and the dealer. The wagering area may include three distinct wagering zones for each player comprising a Bonus wager area 14 (e.g., the Aces-Up wager), an Ante area 16, and a Bet area 18. To initiate play of the game, at least one (and usually only one) deck of standard or variant playing cards is provided. In other forms of the game, multiple intermixed decks of cards, decks with wild cards or special decks (i.e. decks with certain cards removed) are used. Each player who wishes to enter the play of the game makes at least one wager selected from the Bonus Bet (or Aces-Up bet) and the Ante. One or both of these wagers may be made. House rules may dictate that one or both bets are mandatory. The player may also play the hand blind (also referred to as the "House Way") by placing both an Ante and an additional Game Bet (referred to in FIG. 1 as the "Play Bet"). After placement of the at least one wager, each player who has made an at least one wager is provided with a number of cards, preferably five, from which to select a best four-card poker hand. The cards may be dealt as a complete set of five cards or in portions of one or more cards. At about the same time, the dealer is dealt a number of cards exceeding four. In one example of the invention, six cards are dealt. One or more additional cards can be dealt to the player, the dealer or both.

One or more of the player cards can also be dealt as common or community cards. For example, a player might receive four cards in his hand and one card in a community card-designated area on the layout. Each player plays with is or her best three-cards and the community card. Or the player plays with the best four cards, regardless of whether the hand includes one or more community cards.

In a player-banked version, one of the players is the banker and all other players play against the player-banker's hand as if that player were the dealer in a standard casino table game. The dealer's hand of cards is the banker hand, and the banker may or may not have cards in his/her playing area while that player banks the game.

Although in one example of the invention the dealer receives one more card than each player, the number of cards dealt can be equal. What is important is that enough cards are dealt so that at least one discard can be made.

A "player-banked" game operates with essentially the same rules as a standard casino table game, but a player is randomly selected then elects or is elected to bank payments in a round of play, as if the player were the house. Various methods are used by casinos to choose a banker, including random selection, previous immediate winners, and taking turns in order. For example, when a game is offered in a California card room, players bank the game. In order for players to feel they can afford to bank a particular game, the payout odds must be kept low enough to prevent players from avoiding their turn banking the game. The higher bonus payouts or jackpots are therefore preferably eliminated in player-banked versions of the invention. Higher payout odds are acceptable in a more traditional Las Vegas style casino where the house banks the game. Jackpot or super-bonus payouts are therefore usually eliminated in player-banked games, or separate wagers of the jackpot type may be funded by side wagers to the house or to a progressive jackpot.

In the player-banked version, the game is played as a method of playing a player-banked poker-type card game. Each player in the game and a banker places at least one ante wager to participate in the game. In one form of the game, a four card poker hand is played. The players are dealt five cards and the banker receives six cards. The player reviews the five cards received at that player position and determines what best four-card poker hand can be made from the five cards. If the player believes that the cards cannot form a four-card poker rank of sufficiently high rank to warrant competition against the dealer's hand (even without that hand or any portion of that hand having been displayed), the player may fold the hand, refusing to place an additional wager. At this time or usually a later time, the Ante would be collected by the dealer. In one example of the invention, if the player made the Aces-Up bet and the Ante bet and decides to fold, the Aces-Up bet is swept along with the Ante. In another form of the invention, if the player remains in the game by making the Play Bet and the player's hand does not contain a hand ranking of a pair of Aces or higher, and a bet was made on the Ace-Up wager, that wager may be now or later collected by the dealer.

If the player determines that the rank of the best four-card poker hand that can be made from the five cards dealt to the player is sufficiently high as to warrant competition against the dealer (or if the player wants to 'bluff' against the dealer, particularly if the dealer must qualify), the player makes an additional wager, referred to as a play bet or game bet. That additional wager may be multiples of the Ante, such as 1×, 2×, 3×, 4× or 5× the amount of the original Ante, at the option of the player. House rules may dictate the ranges of multiples that can be bet. For example, on high stakes tables, the house may allow higher multiples, while at lower stakes tables, smaller ranges of multiples are permitted.

In some examples of the invention, the game bet is 1× the ante unless the player has a qualifying hand such as a pair of kings or better for example. If the player's hand qualifies he has the option of increasing his bet. Fractional amounts or larger amounts may be allowed, but they can complicate the payout or alter the hold for the house, so those changes are in the discretion of the casino. After discarding excess cards and placing the Game Bet, or placing the fifth card face down, or merely leaving the fifth card in the hand so that the hand may be arranged and ranked by the dealer or player when exposed, the player's hand is placed on the table for display. The dealer's hand is then revealed after each and every player has determined whether or not the Game Bet is to be made. The dealer compares the value or rank of his hand against the value or rank of each player's hand, usually in succession around the table, and each series of wagers (the Aces-Up wager, the Ante and the Game Bet) is resolved. Ties on the rank of player's hands and dealers hands may be either paid to the player, called a push, or collected by the dealer, depending upon the desired house advantage the casino wants to build into the game. The dealer may either always qualify (a preferred method of play), or a level of qualification may be built into the game (such as at least Queen high, at least King high, at least Queen-Jack, At least King-Jack, at least Ace-King, or at least one pair).

Resolution on the wagers may be based upon pay tables for the Aces-Up wager, pay tables on the Ante, and/or the Game Bet. Preferred play of the game provides pay tables for one or more of the Aces-Up wager, the Ante and an automatic bonus payout on the ante. The Game Bet pays one-to-one with a player win. This differentiation is based upon the fact that with certain very high ranking hands, the player would be at an extreme advantage in placing a 5× Game Bet, assuring a very high multiple payout, with essentially no risk or little risk involved in the placement of the 5× Game Bet wager. The payout of wagers may be tailored by the casino by selecting pay tables designed for greater player payouts or greater casino earnings.

Although a four card poker game is one form of the invention, the game could also be played with three, five or seven cards, with necessary adjustments to the pay tables.

For example, in a four card game, the hierarchy of hands is as follows:

Four of a Kind
Straight Flush
Three of a Kind
Flush
Straight
Two Pair
Pair
High Card A three or five card game would require a different hierarchy of hand rankings.

There are many variations of the game that may be played within the scope of the present invention. The following variations on the format described above shall be described in a manner that should enable those skilled in the art to appreciate the expanded scope of play available, rather than considering any single described method as limiting the intended scope of the game.

Version I—Best 4 of 5 Cards No Qualification, Dealer Gets Extra Card

Each player receives 5 cards, and the dealer/banker receives 6 cards. The players and the dealer/banker identify their best four card poker hands. The players may rely upon the house for assistance, if needed. The dealer/banker always qualifies, that is, the dealer's/banker's hand and any players' hands are always in play if the Ante bet is made. Players have the choice of placing one or both of the Ante Bet and a Bonus Bet (e.g., the Aces-Up wager). House rules may require the player to make the Ante Bet, the Bonus Bet, or both the Ante and Bonus Bet. The Ante wager is a wager played directly against the rank of the dealer's hand, and the Aces Up Bonus Bet is a bet against a pay table. If after viewing his/her hand, a player chooses to stay in the game against the dealer/banker (keeping the Ante wager in play), the player must make an additional Game Bet to stay in the game. This Game Bet may be, for example, between 1 and 5 (or between 1 and 4, or between 1 and 3) times the amount of the initial Ante wager at the option of the player. In other forms of the game, the player's Game Bet must be 1× the ante unless the player holds a qualifying hand of a pair of Aces or better. If the player has a qualifying hand, he can bet up to 3× the Ante. Preferably, the player must hold a pair of aces or better to win on the Bonus Bet (hence the name 'Aces-Up'). The Bonus Bet preferably pays a maximum return of 50:1, but payouts may theoretically be as high as 500:1 for certain hands, such as for four Aces. The Bonus Bet side bet game may or may not be present in the rules of the game. In this example of the invention, the game pays an automatic bonus for certain high ranking hands according to a payout schedule. This bonus is paid on the Ante wager, and does not require the player to make a separate bet to qualify for this payout. For example, automatic bonuses are paid on three of a kind, straight flushes and four of a kind.

Version II—Best 4 of 5 Cards, Dealer Must Initially Qualify or Redraw

Each player and the dealer/banker gets five cards to make the best four-card poker hand. If the dealer's/banker's hand does not equal or exceed a certain rank (e.g., a pair of 2's or better), he discards all cards and draws a new five card hand, and then makes a four-card poker hand from the five cards. The player must make the Ante wager to be in the game against the dealer. After redrawing, and when redrawing is not required, the dealer/banker always qualifies to play against the player. It is possible to allow the player or require the player to make the Ante wager 1) before the deal of cards, 2) after the deal of cards but before any cards are revealed, 3) after the deal of cards and after the player has reviewed his cards but before the dealer/banker has exposed cards, 4) after the deal of cards and a partial or complete revelation of the dealer's/banker's five cards (but before review of the player's cards), or 5) after the deal of cards and a review of the players' cards and a partial revelation or complete revelation of the dealer's/banker's five cards, which play might be restricted to where the dealer/banker has not qualified (but not after revelation of any sixth card). The player's hand may be required to exceed a minimum rank to bet more than 1× the Ante. For example, if the player has a qualifying hand of a pair of Kings or better, the player can make a Game Bet of 1×, 2× or 3× the Ante. As with Version I, the rules can provide that the Ante bet is mandatory and the Bonus bet is optional, the Bonus Bet (side bet) is mandatory and the Ante Bet is optional, or both initial bets (the Ante and the Bonus Bet) are mandatory. The automatic bonus against a pay table on the Ante bet may or may not be present in the rules of the game. The Bonus Bet game may or may not be present, also in the rules of the game. In this example, a pair of aces or better qualifies the player for an Aces-Up payout of 1:1. The automatic bonus pays even if the player's hand is lower in rank than the dealer's/banker's hand.

Version III—Dealer and Player's Make Best 4 of 5 Card Hand, Dealer Must Qualify to Play The players and dealer/banker each receive five cards to make their best four-card poker hand. The betting/wagering rules and procedures are the same as in the previous versions, except for those listed below. Either the Ante is mandatory, the Ante or the Bonus Bet is mandatory, or both initial wagers are mandatory. The dealer/banker must qualify to play (for example, with a hand of Ace high or better, King-Queen or higher, Ace-King or higher, pair of deuces or higher, etc.). The automatic bonus side bet game against a pay table is present in the rules of this example of the game, although such side bets and bonuses are often excluded from player-banked games and could be excluded here. Paytable adjustments may or may not be made when excluding the side bet and bonus wagers.

If the player stays in the game, the player can bet between 1× to 3× the Ante if the player has a qualifying hand of a pair of Kings or better. Otherwise, the maximum Game Bet is 1× the Ante. The lowest ranking hand that qualifies for the bonus payout is a pair of Aces or better.

Version IV—Four Card Poker with Super Bonus

The dealer/banker and each player are dealt five cards each. The cards are used to make the best four card poker hand by the players and the dealer/banker. The hands are ranked according to the following four card poker ranking schedule:

Four of a Kind
Straight Flush
Three of a Kind
Flush
Straight
Two Pair
Pair
High Card Players can make a bet against the dealer/banker (Ante), a bet against the pay table (Aces-Up Bonus Bet) or both. House rules may require one or both bets to be mandatory. In addition, the players may or may not be required to make a Super Bonus bet in an amount equal to or unequal to the amount of the Ante in this example of the invention. In one form of the invention, the Super Bonus bet is mandatory and is equal in value to the Ante.

Players place equal bets on the Ante and/or Super Bonus and/or Bonus spots on the layout. After viewing the cards, the player must fold or place an additional Bet (play wager). If the player's hand does not qualify with a pair of Kings or better, he must bet 1× the ante to an in the game. With a qualifying hand of a pair of Kings or better, he can bet an amount equal to or multiples of the Ante, such as 1×, 2× or 3× the Ante.

If the player has a higher ranking hand than the dealer's/banker's hand, the player is paid 1:1 on the ante and the play bet. If the dealer's/banker's hand outranks the player's hand, the player loses the ante and the play bet.

The player has the option (or may be required) at the beginning of the game to place an Aces-Up bonus bet. In this example of the invention, the player wins a bonus payout for a pair of Aces or better. If the player makes the Ante and Play bets and beats the dealer/banker, but does not have a pair of Aces or better, the player pushes on the bonus bet. The player is always paid on the Aces-Up bonus bet, regardless of whether or not the player's hand beats the dealer's/banker's hand.

In addition, this example of the invention includes a mandatory Super Bonus bet that is made in an amount equal to the ante. The player wins a payout for certain high ranking hands such as a straight flush or four of a kind. A pay table is provided on the layout to identify winning hands and payout amounts. These superbonus bets are not typical of player-banked games and may be excluded or may be within the award/play province of the house, card-room, State, commission or the like, and not be controlled by the player/banker.

A failure to obtain a "Super Bonus" hand may or may not result in an automatic loss of the bet. For example, when the player's hand against the dealer/banker does not qualify with a pair of kings or a straight flush or better, but the hand still beats the dealer/banker, the Super Bonus bet pushes. But, if you fold on the ante or lose the ante and play bets against the dealer/banker, the Super Bonus bet is also lost.

The Super Bonus bet is desirable in some instances where it is desired to provide the house or the card room with more of an advantage. In this example of the game, removing the mandatory Super Bonus bet causes the game to favor the player. However, other rule changes such as requiring the dealer/banker to qualify, or raising the minimum qualification hand ranking when making the play bet are other means to shift the odds to favor the house.

Version V—Player Banked Card Room 4-Card Poker Game

This game is a simplified version of traditional Four Card Poker. First, the "Aces Up" bonus bet is eliminated to reduce volatility in the game. The game must be less volatile in order to encourage the players to bank the game. If the banker chooses to bank only to a certain amount, a syndicate banker may back up the hand. If no player wishes to bank the hand, the syndicate banker may act as banker.

The house is compensated by taking a percentage of the amounts wagered, a fixed fee per round or a fee per unit of time. Most commonly the house takes a percentage of amounts wagered.

The dealer holds and manages the banker's hand. When the banker is banking the game, all moneys lost go to the banker, and all monies won are paid by the banker. If the banker's funds are limited and cannot cover all the action, the bets that are not covered are returned to the player, or are backed by a back-up banker, which is typically a syndicate banker, but could be another player. Alternately, the syndicate banker may bank the entire game. The order in which the players are permitted to bank the game is determined by the house. Typically the player position is randomly selected and then players are selected in clockwise or counterclockwise order in future rounds.

As with the traditional game players and the dealer receive five cards to make a best four card poker hand. The player must make a play wager to stay in the game. The play wager is 1× to 3× the Ante wager, at the option of the player. Higher multiples of the Ante may be played such as 4× or 5× the Ante. If the player chooses not to stay in the game, the player folds and loses the Ante wager. There is no player qualification to increase the bet above 1× the Ante.

In this form of the game, once the Play wager is made, the dealer stacks the Play and Ante wagers and the wager becomes one single wager. Merging the wagers into a single wager simplifies resolution of the wager for the dealer. There is no dealer or player minimum qualifying hand in this form of the game.

Whenever the player's hand outranks the banker's hand, the player wins on the bets that are in action. If the rank of the player and dealer's hand is the same, players win. The typical payout is 1:1 on the Ante/Bet combination but there are exceptions. For certain high-ranking hands, higher odds payouts are paid on the Ante/Bet combination, rather than 1:1 odds. Higher payout odds are only paid if the player hand beats the dealer hand. For example, if a player has a four of a kind (of 3's), while the dealer has a four of a kind (of 2's), the player wins 3:1 on the Ante and Play wagers.

An exemplary pay table for this form of the game is shown below:

| Hand | Payout on Ante/Bet Combination |
|---|---|
| Four of a Kind | 5:1 |
| Straight Flush | 4:1 |
| Three of a Kind | 3:2 |
| All other winning hands | 1:1 |

Automatic bonuses may or may not be part of the game. Automatic bonuses may be paid on the Ante/Bet or on the Ante, or on the Bet only for certain high ranking hands. For example a 4 of a kind, a straight flush and three of a kind could pay automatic bonus odds payouts. Corresponding odds payouts are paid and are typically shown on a pay table printed on the layout.

The play of the game may be completed manually on a non-electronic game table, with the dealer using a physical deck(s) of cards, visually identifying the amounts and positions of wagers, manually collecting and paying out wagers, etc. It is possible to incorporate some degree or nearly an entire electronic system into the game table or into the play of the game. Such partial or complete electronic systems may perform such tasks as identifying the existence of a wager (e.g., U.S. Pat. Nos. 6,229,534; 5,337,973; and 5,377,994), or may provide virtual cards from an electronically stored deck of cards (e.g., U.S. Pat. Nos. 5,255,915; and 5,897,436). The games of the present invention could also be executed on a multiple player gaming platform including a simulated virtual dealer, such as the device and system described in U.S. patent application Ser. No. 09/179,748, filed Oct. 28, 1998, now U.S. Pat. No. 6,607,443. The content of this patent specification is hereby incorporated by reference.

The capabilities of technology are constantly expanding, and the improvements in technology should not be considered to avoid the underlying invention of the play of this game. For example, player monitoring systems, security systems, integrated systems where shufflers identify the number of cards and/or identify the specific cards and their positions in the play of the game are contemplated in the practice of the present invention.

There are a number of advantages in the game of the present invention. The fold rate on this game is approximately 21%, which is lower than the fold rate in other known games, such as Three Card Poker®. This feature is believed to attract and retain players, making the game more appealing to casinos.

Players win this game approximately 48% of the time, which exceeds the expectation of many players, and increases player appeal. In some situations, e.g., when the player has a qualifying hand, additional betting opportunities are available, such as tripling down on the Ante, increasing player appeal.

By varying the number of cards made available to the dealer/banker and/or players, in forming the hands, by requiring the dealer's/banker's hand to qualify or by eliminating dealer qualification, by modifying the payouts and winning hand combinations possible on the bonus bet, by adding the Super Bonus bet etc., the payouts can be made to pay as high as 500:1 e.g., for four of a kind hands. This feature is believed to attract and retain more poker players.

What is claimed:

1. A player-banked casino game play method utilizing at least one deck of playing cards, the method comprising:

each player placing at least one wager to participate in the casino game;

dealing a first number of cards to a dealer as a banker hand, said first number of cards being greater than four cards to be used in determination of a four-card poker rank hand for the banker hand;

dealing a second number of cards to each player, said second number of cards being less than the first number of cards and greater than the four cards to be used in determination of a four-card poker rank hand for each player;

the player making a second wager to remain in the game or folding;

the dealer utilizing fewer than all of the cards dealt to form a resulting single banker four-card hand;

each player utilizing fewer than all of the cards dealt to form a resulting player's four-card hand for each player, wherein the number of cards utilized in the resulting player's hands and the resulting banker's hand are four cards; and resolving each player hand against the banker's hand according to predetermined game rules.

2. The casino game of claim 1 wherein physical cards are provided to each player and the dealer.

3. The casino game of claim 1 wherein the first number of cards is six cards and the second number of cards is five cards and the resulting number of dealer's cards in the banker's hand and the resulting number of player cards are both four cards.

4. The casino game play method of claim 1 wherein the game is implemented on a multiple player gaming platform.

5. The casino game of claim 1 wherein the player makes a Play wager prior to review of that player's second number of cards.

6. The casino game of claim 5 wherein after the player reviews that player's second number of cards, that player may place the Play wager of at least 1× the Ante wager to stay in the game.

7. The casino game of claim 5 wherein after the player reviews that player's second number of cards, that player may place the Play wager of greater then 1× the Ante wager only when the player's resulting number of cards' hand exceeds at least a predetermined minimum poker ranking for a player's hand.

8. The casino game of claim 7 wherein the Play wager of greater than 1× is an amount equal to a multiple of the Ante wager.

9. The casino genie of claim 8 wherein the multiple of the Ante wager may be selected by the player from en available group of wagers selected from the group consisting of 1×, 2×, 3×, 4× and 5×.

10. The casino game of claim 1 wherein the first number of cards exceeds the second number of cards by at least one card.

11. The casino game of claim 1, wherein each player places at least one of an Ante and a Bonus Bet, and when a bonus bet is placed, paying the player a payout for achieving a predetermined winning card combination.

12. The casino game of claim 11, wherein multiple winning combinations are predetermined, and payouts and combinations are displayed on a pay table.

13. The casino game of claim 11, and further comprising an automatic bonus paid on the ante for at least one predetermined winning combination.

14. The method of claim 1, and further including a mandatory Super Bonus bet which must be made prior to the player receiving the second number of cards, wherein payouts are made on the Super Bonus bet for predetermined hand ranks.

15. The method of claim 14 wherein the Super Bonus bet pays odds for predetermined winning hands.

16. A player-banked casino game play method utilizing at least one deck of playing cards, the method comprising:

each player placing at least one Ante wager to participate in the casino game;

dealing a first number of cards to a dealer as a banker hand, said first number of cards being greater than the number of cards to be used in determination of a poker rank hand for the banker hand;

dealing a second number of cards to each player, said second number of cards being greater than the number of cards to be used in determination of a poker rank hand for each player;

the dealer utilizing fewer than all of the cards dealt to form a resulting single banker hand;

each player utilizing fewer than all of the cards dealt to form a resulting player's hand for each player, wherein the number of cards utilized in the resulting player's hands and the resulting banker's hand are equal; and resolving each player hand against the banker's hand according to predetermined game rules, wherein the first number of cards and the second number of cards are both five cards and the resulting number of dealer's cards in the banker's hand and the resulting number of player cards are both four cards wherein, if the banker's hand does not have at least a minimum predetermined rank of poker hand, the banker's hand is provided with one more additional card.

17. The casino game of claim 16 wherein the player makes another Play wager prior to review of that player's second number of cards.

18. The casino game of claim 17 wherein after the player reviews that player's second number of cards, that player may place another Play wager of at least 1× the Ante wager.

19. The casino game of claim 17 wherein after the player reviews that player's second number of cards, that player may place another Play wager of greater then 1× the Ante wager if the player's resulting number of cards' hand exceeds at least a predetermined minimum poker rank for a player's hand.

20. The casino game of claim 19 wherein the multiple of the Ante wager may be selected from the group consisting of 1×, 2×, 3×, 4× and 5×.

21. The casino game of claim 20 wherein physical cards are provided to each player and the dealer.

22. The casino game of claim 20 wherein the first number of cards exceeds the second number of cards by at least one card.

23. The casino game of claim 22 wherein physical cards are provided to each player and the dealer.

24. The casino game of claim 17 wherein physical cards are provided to each player and the dealer.

25. The casino game of claim 17 wherein the first number of cards exceeds the second number of cards by at least one card.

26. The casino game of claim 25 wherein physical cards are provided to each player and the dealer.

27. The casino game of claim 16 wherein physical cards are provided to each player and the dealer.

28. The casino game of claim 16 wherein the first number of cards exceeds the second number of cards by at least one card.

29. A live player-banked casino game play betting method comprising the steps of:

each player placing a first wager to participate in a live casino game;

a dealer dealing a plurality of cards to each player;

the dealer dealing a plurality of cards to the dealer as a banker's hand; each player optionally folding or making an additional bet that is a multiple of the first wager, wherein the multiplication factor is at least 1 and selected by the player; and resolving the wager according to predetermined game rules; and wherein both the dealer excludes at least one card from determining a hand to be ranked and each player excludes at least one card from each player's hand to form a hand to be ranked against the banker's hand; wherein the dealer and the player are initially dealt exactly five cards and resolution of game rules is based upon ranking of four card hands, and the dealer is dealt a sixth card for the banker's hand only if the dealer's four-card poker hand rank with the initial five cards in the banker's hand does not at least equal a predetermined banker's minimum hand rank.

30. The method of claim 29 wherein the banker's minimum hand rank is at least a rank less than one pair.

31. The method of claim 29 wherein the banker's minimum hand rank is at least a rank of one pair.

32. The method of claim 29 wherein the at least a first wager is an Ante and the player must make the additional wager to stay in the game, and the additional wager is a multiple selected by the player from values between 1× and 5×.

33. The method of claim 32 wherein the multiple wager may exceed 1× only if a player's four-card poker rank exceeds a predetermined player's minimum four-card poker rank.

34. The method of claim 29 wherein the at least a first wager is an Ante and the player must make the additional wager to stay in the game, and the additional wager is a multiple selected by the player from the group consisting of 1×, 2×, 3×, 4× and 5×.

35. The method of claim 34 wherein the multiple wager may exceed 1× only if a player's four-card poker rank exceeds a predetermined player's minimum four-card poker rank.

36. The method of claim 29 wherein the dealer is provided with one additional card for the banker's hand after receiving the dealer's initial plurality of cards.

37. The method of claim 36 wherein the player may make an additional wager before the dealer receives the additional card for the banker's hand.

38. The method of claim 37 wherein the player may make the additional wager after the dealer has determined that a four-card poker rank of the banker's hand in the initial cards dealt does not meet at least a rank of a banker's predetermined minimum four-card poker rank.

39. A player-banked casino game play method utilizing at least one deck of playing cards, the method comprising:

each player placing at least one wager to participate in the casino game and an additional mandatory or optional side bet wager that pays odds for predetermined winning hand ranks;

dealing a first number of cards to a dealer as a banker hand, said first number of cards being greater than a second number of four cards to be used in determination of a poker rank hand for the banker hand, which second number is four cards;

dealing a third number of cards to each player, said third number of cards being less than the first number of cards and greater than the second number of four cards to be used in determination of a poker rank hand for each player;

the player making a second wager to remain in the game or folding;

the dealer utilizing fewer than all of the cards dealt to form a resulting single banker four-card hand;

each player utilizing fewer than all of the cards dealt to form a resulting player's four-card hand for each player, wherein the number of cards utilized in the resulting player's hands and the resulting banker's hand are equal; and resolving each player hand against the banker's hand according to predetermined game rules.

40. The method of claim 39 wherein the at least one wager is an Ante and the player must make the additional wager to stay in the game, and the additional wager may be a player selectable multiple of the Ante selected at the election of the player.

41. The method of claim 39 wherein the at least one wager is an Ante and the player must make the additional wager to stay in the game, and the additional wager may be a multiple of the Ante selected from the group consisting of 1×, 2×, 3×, 4× and 5× at the election of the player.

42. The method of claim 41 wherein the first number is 6 and the third number is 5.

43. The method of claim 39 wherein the first number is 6 and the third number is 5.

44. A casino game play method utilizing at least one deck of playing cards, the method comprising:

each player placing at least one wager to participate in the casino game and an additional mandatory or optional side bet wager that pays odds for predetermined winning hand ranks;

dealing a first number of cards to a dealer, said first number of cards being greater than four cards to be used in determination of a four-card poker rank hand for the dealer hand;

dealing a second number of cards to each player, said second number of cards being less than the first number of cards dealt to the dealer and greater than the four cards to be used in determination of a four-card poker rank hand for each player;

the player making a second wager to remain in the game or folding;

the dealer utilizing fewer than all of the cards dealt to the dealer to form a resulting single dealer four-card hand;

each player utilizing fewer than all of the cards dealt to each player to form a resulting player's four-card hand for each player, wherein the number of cards utilized in the resulting player's hands and the resulting dealer's hand are four cards; and resolving each player hand against the dealer's hand according to predetermined game rules.

45. The method of claim 44 wherein the at least one wager is an Ante and the player must make the additional wager to stay in the game, and the additional wager may be a player selectable multiple of the Ante selected at the election of the player.

46. The method of claim 44 wherein the at least one wager is an Ante and the player must make the additional wager to stay in the game, and the additional wager may be a multiple of the Ante selected from the group consisting of 1×, 2×, 3×, 4× and 5× at the election of the player.

47. The method of claim 46 wherein the first number is 6 and the third number is 5.

48. The method of claim 44 wherein the first number is 6 and the third number is 5.

* * * * *